United States Patent [19]

Watanabe

[11] 4,438,745

[45] Mar. 27, 1984

[54] ENGINE IDLE SPEED CONTROL DEVICE

[75] Inventor: Shunso F. Watanabe, Livonia, Mich.

[73] Assignee: Ford Motor Company, Dearborn, Mich.

[21] Appl. No.: 415,050

[22] Filed: Sep. 7, 1982

Related U.S. Application Data

[63] Continuation-in-part of Ser. No. 404,183, Aug. 2, 1982, abandoned.

[51] Int. Cl.[3] ..... F02D 9/08

[52] U.S. Cl. ..... 123/339; 123/337; 123/585

[58] Field of Search ..... 123/339, 337, 585; 261/65

[56] References Cited

U.S. PATENT DOCUMENTS

| | | | |
|---|---|---|---|
| 4,064,857 | 12/1977 | Williams | 123/337 |
| 4,158,352 | 6/1979 | Blatter | 123/337 |
| 4,212,272 | 7/1980 | Hawk | 123/339 |
| 4,408,581 | 10/1983 | Pfalzgraf et al. | 123/339 |

*Primary Examiner*—Andrew M. Dolinar
*Attorney, Agent, or Firm*—Robert E. McCollum; Clifford L. Sadler

[57] ABSTRACT

An air or air/fuel throttling body contains a main air or air/fuel induction passage with a main rotatable throttle plate movable across the passage to variably control the flow through it. Additionally, a shuttle type slide valve is mounted on the main throttle plate and provided with openings that are adapted to be aligned or misaligned at times with apertures in the main throttle plate to control the flow of an additional volume of air or air/fuel through the throttle valve into the engine regardless of the attitude or position of the main throttle plate and supplementing the flow normally passing around the throttle plate; the shuttle valve being moved by power means energized by an electrical signal from a microprocessor having inputs sensing operating conditions of the engine to position the slide valve to maintain an idle speed schedule.

5 Claims, 13 Drawing Figures

ENGINE IDLE SPEED CONTROL DEVICE

This application is a continuation-in-part of co-pending application Ser. No. 404,183 filed Aug. 2, 1982, now abandoned, titled Engine Idle Speed Control Device.

This invention relates in general to an automotive type engine idle speed control. More particularly, it relates to one that can vary the volume of air or air/fuel flow into the engine regardless of the position of the throttle valve.

It is important for fuel economy, driveability and emission purposes, among other things, to control the idle speed of an engine. It must be maintained at a level high enough to prevent engine stalling under load at closed throttle idle speed positions, and yet be as low as possible to conserve fuel and minimize the output of unburned hydrocarbons, etc.

The simplest control is no control at all. That is, by setting the engine idle speed high enough, it will prevent stalling when the engine is suddenly placed under load such as, for example, when the air conditioning or power steering units are placed in operation. The disadvantage of such a high idle speed, however, is that unnecessary fuel may be burned, the driveability of the vehicle may depreciate, and incomplete combustion may occur leading to the emission of unburned hydrocarbons into the atmosphere.

Typical types of idle speed controls include systems that sense the position of the carburetor throttle valve and then readjust the position, or adjust the throttle valve when loads are imposed on the engine, to maintain a predetermined idle speed level.

This invention relates to a relatively simple mechanism for adjusting the air or air/fuel flow to the engine regardless of the position of the throttle valve. More particularly, it relates to a shuttle valve slidably mounted on the throttle plate to variably control an overlap of openings in both members through which air can pass to the engine. Sensor means connected to a microprocessor can vary the air flow as a function of engine operating conditions to automatically maintain the idle speed at a scheduled level regardless of the load being imposed upon the engine and regardless of the particular position of the throttle valve.

Devices are known for variably controlling the air or air/fuel flow to the engine by means of rotary or sliding type air control valves. For example, U.S. Pat. No. 4,112,901, Chapin et al, shows a rotary equalizer valve 62, which through cooperating slots provides conical openings through a pair of members to control air flow to the intake manifold of an internal combustion engine. The figures, however, clearly indicate a complicated structure to accomplish this control. Chapin et al does not show a simple throttle valve or plate to which is attached a sliding shuttle valve controlled electronically in response to engine operating conditions to automatically maintain a scheduled engine idle speed. The equalizer valve 62 of Chapin et al is a fuel control valve and in no way is associated with a throttling air control valve common to most charburetor air throttle bodies.

U.S. Pat. No. 2,925,257, Cohn, shows a rotary fuel induction system in which a pair of trapezoidal-like shaped elements cooperate with one another to control the volume of fuel and air flow into an engine. In the majority of embodiments, Cohn shows a rotary type slide valve for variably adjusting the air and fuel. Cohn, however, does not show the simple construction of a throttle valve with a sliding type shuttle valve overlying the throttle valve and controlled in response to engine operating conditions to automatically maintain the air flow to provide a scheduled engine idle speed independently of control of the flow by the throttle valve and independently of the position of the throttle valve.

It is a primary object of the invention, therefore, to provide an engine idle speed control device that includes a shuttle type slide valve mounted on an essentially conventional rotary throttle valve in an engine induction passage to vary the air or air/fuel flow into the engine independently of air flow past the throttle valve and independently of the position of the throttle valve.

It is also an object of the invention to provide an engine idle speed control device as described in which the shuttle valve overlies the main throttle valve or plate and has apertures adapted to be progressively aligned with openings in the throttle valve to variably increase or decrease additional air or air/fuel flow through the throttle valve; the shuttle valve being slidable in response to solenoid means activated in response to engine operating conditions controlling the operation of a microprocessor means sensitive to the throttle valve position to automatically maintain the engine at a scheduled idle speed.

Other objects, features and advantages of the invention will become more apparent upon reference to the succeeding, detailed description thereof, and to the drawings illustrating the preferred embodiment thereof; wherein, FIGS. 1 and 2 are plan and side elevational views, respectively, of a throttle body embodying the invention;

FIG. 9 is an enlarged cross-sectional view of a modification;

Figure 1:
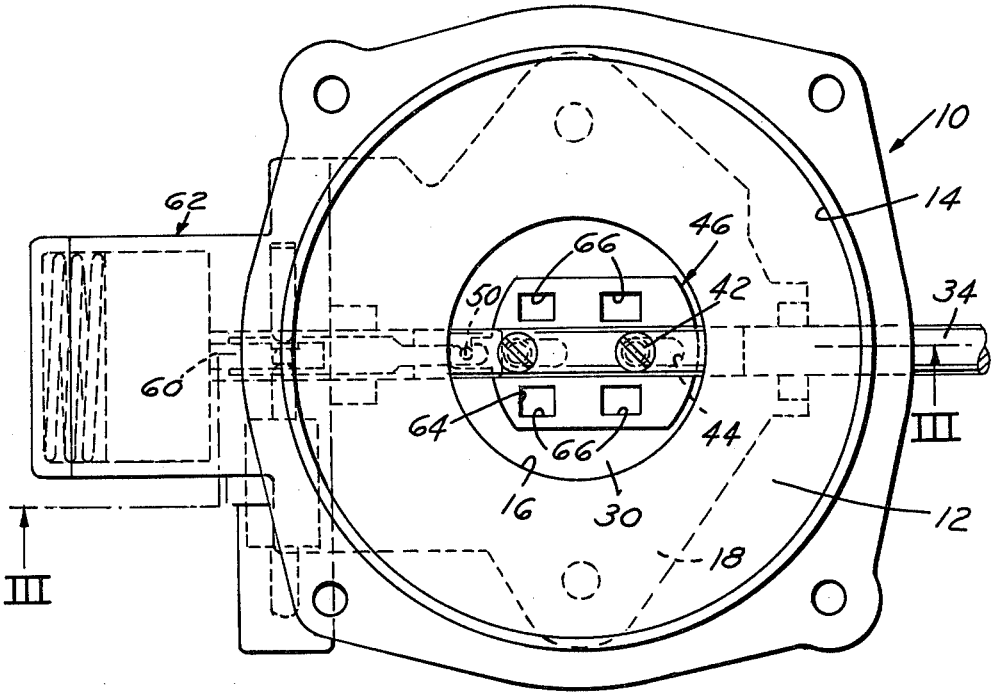
Figure 2:
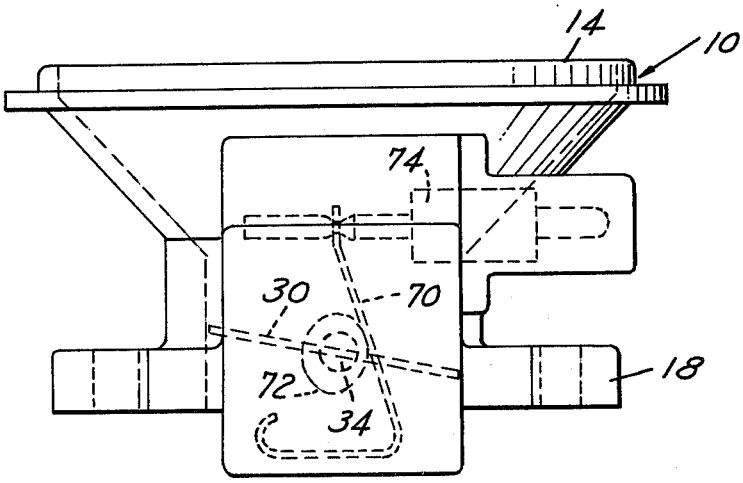
Figure 3:
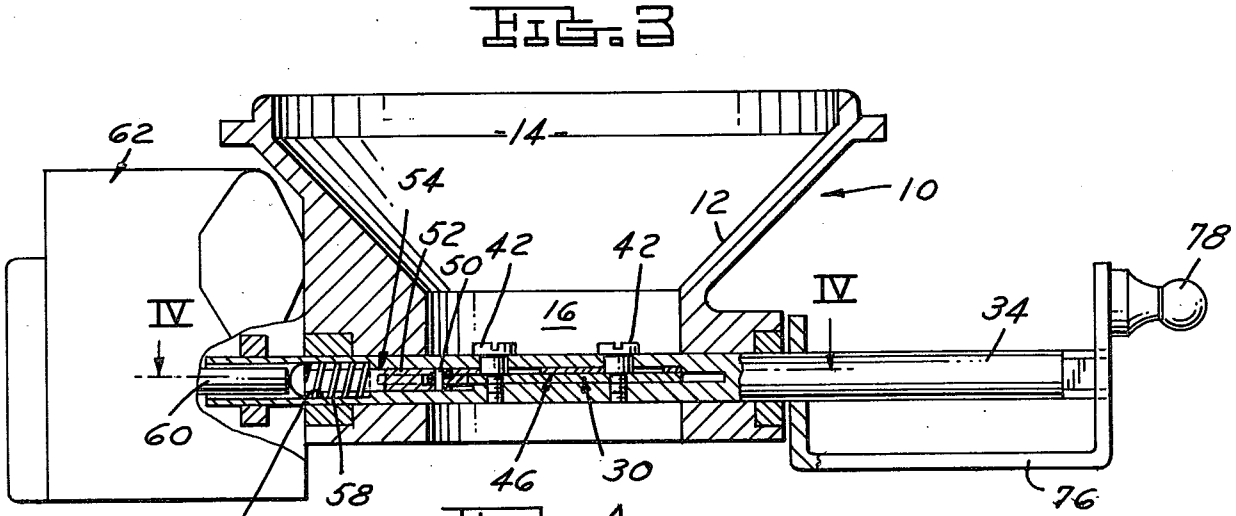
FIG. 3 is a cross-sectional view taken on a plane indicated by and viewed in the direction of the arrows III—III of FIG. 1.

FIGS. 1 to 3 show a throttle body 10 provided with a through air or air/fuel induction passage 12. The upper portion of the passage has a conically shaped air inlet 14 converging to a cylindrical throttle bore 16 of constant diameter. The lower portion of the bore 16 in this case is adapted to be mounted on the engine intake manifold (not shown), the two being attached by means of a mounting flange 18.

Body 10 is shown in this case as being merely an air throttling body. However, it will be clear that it could control an air/fuel charge within the scope of the invention. For example, the air throttle body 10 could be part of a central fuel injection system in which an injector would be mounted above inlet 14.

Figure 4:
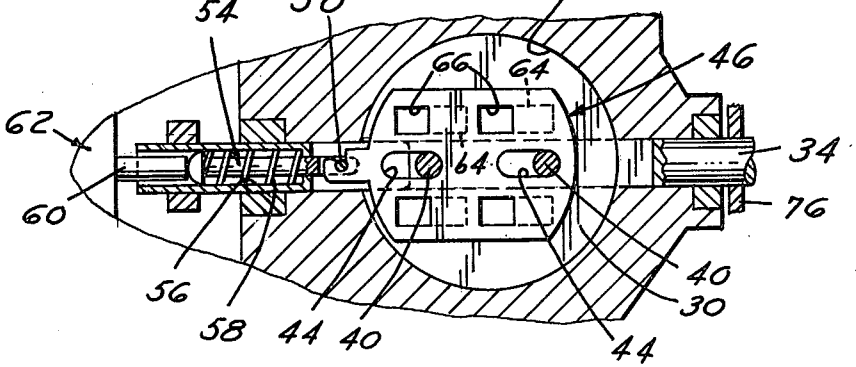
FIG. 4 is a cross-sectional view taken on a plane indicated by and viewed in the direction of the arrows IV—IV of FIG. 3, with the parts moved to different operative positions.
Figure 5:
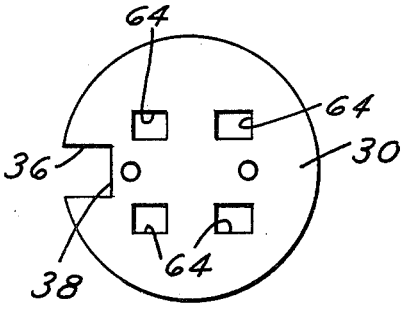
FIGS. 5, 6 and 7 are views of details shown in FIGS. 3 and 4.

The flow of air and fuel through induction passage 12, in this case, is controlled by a round throttle plate or valve 30 that is conventional except for the modification to incorporate the invention. More particularly, throttle plate 30 is a flat disc, as best seen in FIG. 5, that is inserted laterally into a slot 32 formed for this purpose in a throttle plate shaft 34 shown more clearly in FIGS. 3, 4, 7 and 8. The throttle plate 30 is formed with a notch 36, the closed end 38 of which serves as a stop for a slide valve to be described. Throttle plate 30 is attached to shaft 34 by means of a pair of mounting screws 40.

Figure 6:
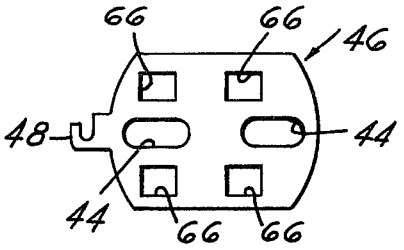
Figure 8:
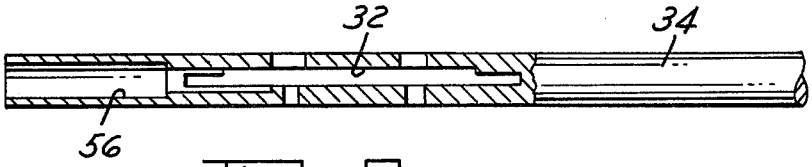
FIG. 8 is a cross-sectional view taken on a plane indicated by and viewed in the direction of the arrows VIII—VIII of FIG. 7.
Figure 7:
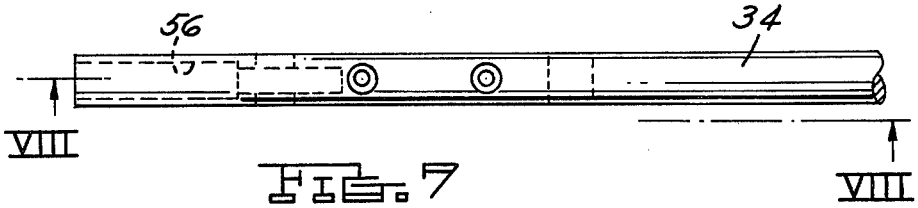

The enlarged upper portions 42 (FIG. 3) of screws 40 are formed as guide pins or cams that are slidably received within a pair of elongated slots 44 in a shuttle type slide valve 46, seen separately in FIG. 6. The shuttle valve is a plate or disc with a hook type connector 48 that is vertically offset from the plane containing the body of the slide valve. Connector 48 is attached by a pin 50 to a yoked end connection 52 of an actuator pin 54 that is slidably movable in a recess 56 in throttle shaft 34. A spring 58 lightly biases actuating pin 54 against the end of a movable armature 60 of a solenoid indicated in general at 62. The solenoid constitutes a power means to move actuating pin 54 and slide valve 46 relative to throttle plate 30, in a manner to be described.

As best seen in FIGS. 5 and 6, throttle plate 30 and slide valve plate 46 each have four apertures in holes 64 and 66, respectively, that are adapted to be aligned with one another when slide valve 46 is moved relative to throttle plate 30 to one position, or misaligned when the slide valve is moved in the opposite direction. FIG. 3 illustrates the shuttle valve 46 moved to the right to its extreme position fully aligning apertures 64 with holes 66 to allow a maximum air flow therethrough. FIG. 4, on the other hand, illustrates slide valve 46 moved to the extreme left position in which holes 66 in the slide plate are misaligned with apertures 64 in the throttle plate to block or close off any air flow through the throttle plate. Obviously, the number of holes 66 and apertures 64 can be as desired. Also, it will be clear the slide valve can be moved progressively between the two extreme positions to variably control the flow of air and fuel past the throttle valve or plate to the engine at essentially any angular position of the throttle plate and independently of flow around the throttle plate. The means for accomplishing this movement is solenoid 62.

More specifically, as best seen in FIGS. 1 and 2, the solenoid control means includes a throttle plate position sensor. It consists of a spring type potentiometer 70, the angular position of which is varied by a cam 72 fixedly attached to throttle shaft 34. At its upper end, spring potentiometer 70 is connected to the plunger of an electrical sensor indicated in general at 74. Further details of construction and operation of the sensor are not given because they are known and believed to be unnecessary for an understanding of the invention.

Suffice it to say that clockwise rotation of throttle plate 30, for example, will cam the spring 70 rightwardly thereby moving the plunger of sensor 74 and providing an appropriate electrical output signal. This signal would be fed to a microprocessor unit, not shown, that would also receive input signals from varous portions of the engine indicating, for example, engine speed, temperature, manifold vacuum, and other desired parameters that would indicate the operating condition of the engine at any particular time. The microprocessor, in turn, would provide an output inter alia to the solenoid control means 62 to energize or deenergize it, as the case may be, causing a rightward movement of armature 60 or a retraction of the same by the bias of plunger spring 58. Movement of armature 60 to the right would cause a corresponding movement of actuator pin 54 to move slide valve plate 46 in the same direction.

Thus, a signal or command from the microprocessor to the solenoid control means 62 would position the slide valve 46 relative to throttle plate 30 to variably open or close the aligned openings 66 and apertures 64 in the slide valve and throttle plate to thereby control the flow of air/fuel or air through the throttle plate into the engine that is independent of the flow around the throttle plate and independent of the position of the throttle plate.

Completing the construction, the right-hand portion of the throttle body, as seen in FIG. 3, contains the usual yoke type actuator 76 with a spherical ball type adapter 78 adapted to be connected to the conventional accelerator pedal linkage leading to the vehicle passenger compartment. Depression of the accelerator pedal by the operator will rotate the actuator 76 and throttle shaft 34 to open throttle plate 30 progressively to a desired position. Independently of the angular open position of the throttle plate, a signal from the microprocessor to move slide plate 46 will cause a separate flow of air or air/fuel through the openings in throttle plate 30 and slide valve 46 into the engine to supplement that already provided by flow past the main throttle plate 30 per se.

Figures 10, 11, 13:
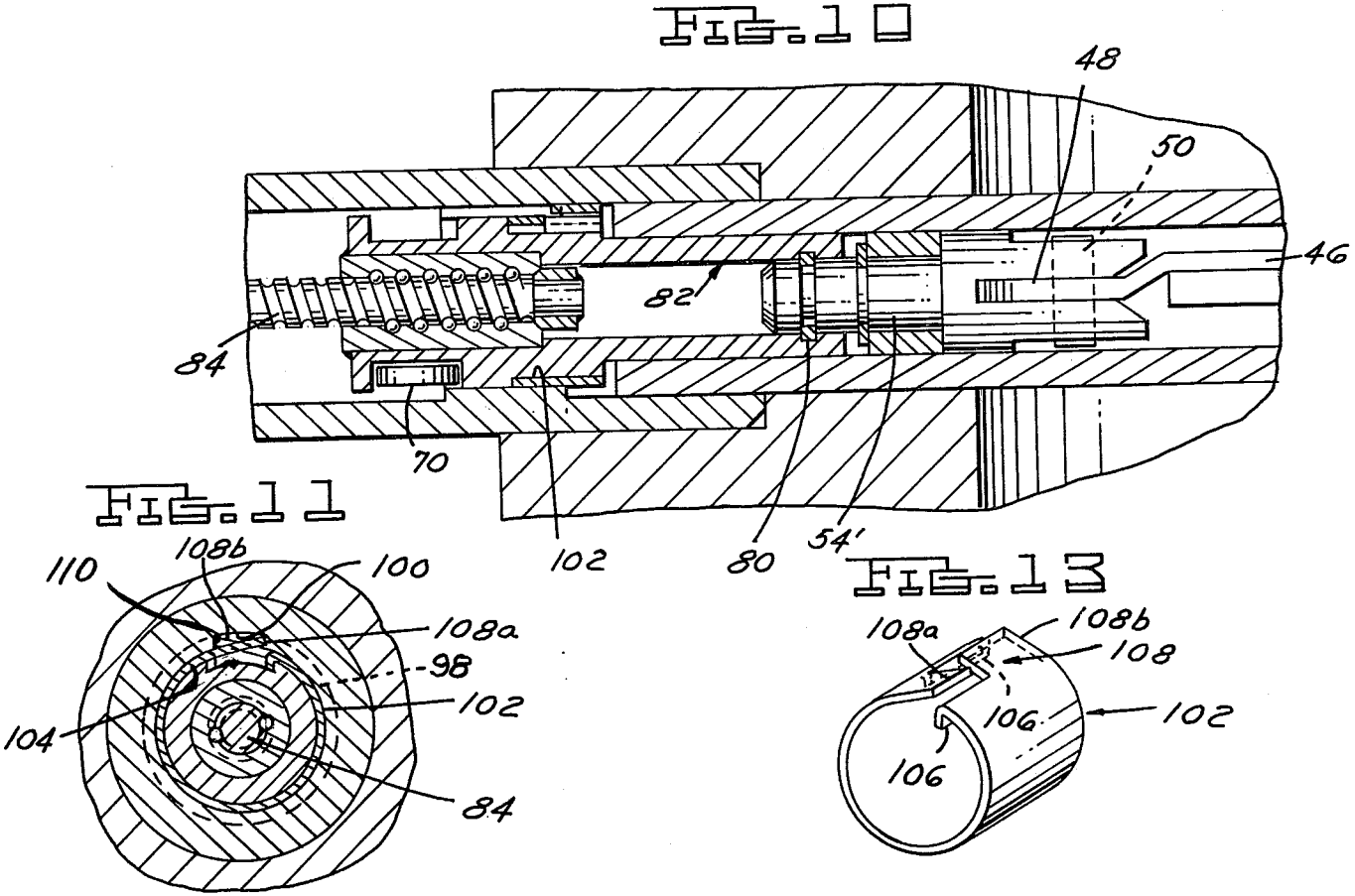
FIG. 10 is a view corresponding to FIG. 9, with the parts rotated 90°.
FIG. 11 is a cross-sectional view taken on a plane indicated by and viewed in the direction of the arrows XI—XI of FIG. 10; and, FIGS. 12 and 13 are prospective views of details of FIGS. 9–11.

FIGS. 9 through 13 illustrate a modified actuator for moving shuttle plate 46. More specifically, the shuttle plate is adapted to be moved by a screw drive mechanism similar to that fully shown and described in copending application Ser. No. 425,828, filed Sept. 28, 1982, entitled Anti-Jamming Mechanism for Linear Translatory Device, and having a common assignee. As shown in FIGS. 9 and 10, the vertically offset end 48 of shuttle plate 46 is connected by pin 50 to an actuator pin or plunger 54'. The latter is fastened by a C-clip 80 to a sleeve or tubular member 82 welded or otherwise secured to the outer ball bearing race of the helical screw drive 84. The screw drive is connected at its leftward end to the armature 60' of a motor 62', and is rotatably but nonaxially movably mounted in a bearing 86 (FIG. 9). The latter is fixed within an outer stationary tubular housing 88 having an opening 90.

The leftward end of sleeve 82 is formed as a collar for attachment of position sensor lever 70'. The latter extends through opening 90 for engagement with the movable portion 92 of a potentiometer type sensor 74'. Axial movement of sleeve 82 in response to a drive by the screw 84 will pivot lever 70' about its fixed pivot 94 to actuate sensor 74'. The latter will then relay this signal to the microprocessor, which will then control motor 62' in the appropriate manner.

Figures 5, 12:
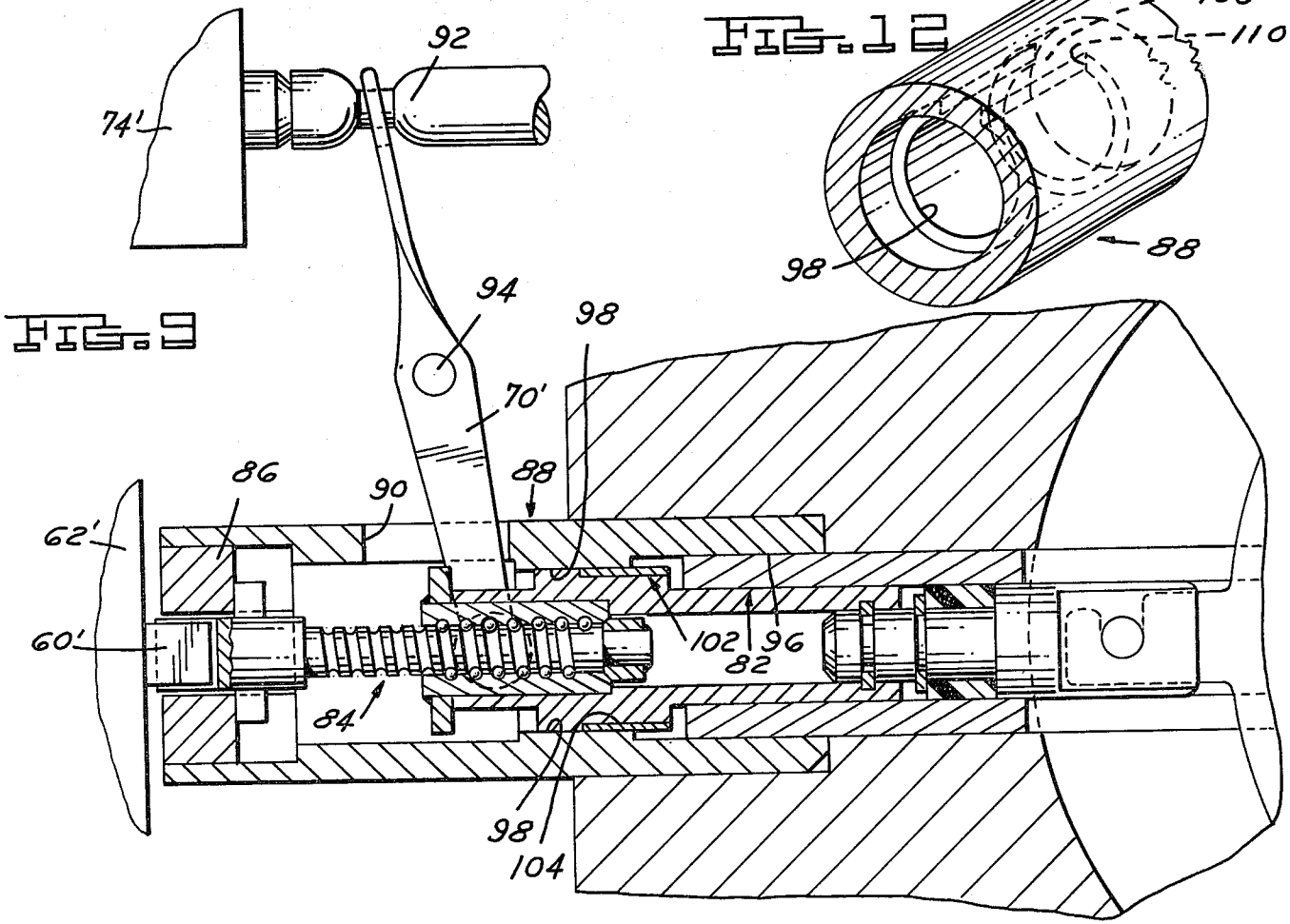

Outer housing 88 is formed with a stepped diameter inner surface 96 within which is rotatably and slidably mounted the sleeve 82. The stepped inner surface 96 provides one axially extending step surface 98 of lesser radial extent than the major remaining portion of surface 96. As best seen in FIGS. 11 and 12, step 98 is provided with a narrow axially extending slot 100. The slot receives within it the tang-like ends of a collar 102 that is clamped around a relieved portion 104 of sleeve 82, as best seen in FIG. 11. Collar 102 (FIG. 13) is a one-piece split spring steel band with half of each of the end portions 106 being bent radially inwardly as retainers to engage in a slot formed in sleeve 82 (FIG. 11). The other half of the end portions 108 constitute flexible finger-like circumferentially extending tabs 108*a* and 108*b* adjacent one another and extending in opposite circumferential directions.

The collar 102 prevents a jamming of sleeve 82 and shuttle valve 46 against the carburetor wall by an overtravel of the sleeve by screw 84. That is, referring to FIG. 11, the spring-like flexible fingers 108*a* and 108*b* of collar 102 extend outwardly to a radial distance that is between the inner diameters of housing 88 and step 98. Therefore, when screw 84 is rotated counterclockwise, for example (FIG. 11), rotation of collar 102 in the same direction will abut the flexible finger end 108*b* against the radial wall 110 (FIGS. 11, 12) of step 98 to prevent rotation of sleeve 82. Clockwise rotation of screw 84 now will cause an axial translation movement of sleeve 82 and shuttle valve 46. When sleeve 82 has moved rightwardly (FIG. 9) sufficient for finger 108*b* to clear the right end of step 98, then sleeve 82 will be free to rotate with screw 84. The other flexible tang 108*a* at this time will merely ratchet counterclockwise over the inner surface of step 88.

When screw 84 is rotated in the opposite clockwise direction, the flexible finger 108*a* now becomes the reaction member to prevent rotation of sleeve 82. Accordingly, continued clockwise movement (FIG. 11) of screw 84 will cause an axial movement of sleeve 82 to the left, as seen in FIG. 9, for a corresponding movement of shuttle valve 46. When finger 108*a* passes the left end of step 98, sleeve 82 will again be free to rotate clockwise and axial movement of it and shuttle valve 46 will be terminated. The finger 108*b* at this time will merely ratchet over the inner surface of step 98.

From the foregoing, it will be seen that the invention provides a relatively simple mechanism for controlling the idle speed condition of an engine independently of the angular position of the main throttle plate and independently of the volume of flow past the main throttle to maintain the engine at a scheduled speed regardless of load conditions suddenly imposed that would tend to decrease the engine idle speed level.

While the invention has been shown and described in its preferred embodiments, it will be clear to those skilled in the arts to which it pertains that many changes and modifications may be made thereto without departing from the scope of the invention.

I claim:

1. An engine idle speed control device for an automotive type internal combustion engine having an air throttling body with an air induction passage therethrough and a disc type throttle plate mounted for a rotatable movement across the passage between an essentially closed idle speed position and a wide open position to control flow of air through the passage, the device including an opening through the throttle plate for the passage of air therethrough, a shuttle type slide valve slidably mounted for a movement across the opening to variably control the flow of air therethrough, and power operated means responsive to engine operating conditions to move the slide valve to control the air flow through the opening to control the engine speed independently of the angular position of the throttle plate and the air flow around the throttle plate.

2. A device as in claim 1, the throttle plate opening comprising a plurality of spaced apertures, the slide valve comprising a flat plate overlying the throttle plate, pin and elongated slot means interconnecting the two plates for a relative sliding movement therebetween, the slide valve plate having a plurality of holes corresponding in number to the apertures in the throttle plate and being movable in a manner to progressively align the holes with the apertures upon sliding movement of the slide valve plate in one direction to a fully open position to increase air flow through the throttle plate and being movable progressively to a fully closed position misaligning the apertures and holes upon sliding movement of the slide plate in the opposite direction to decrease the air flow through the throttle plate, and spring means biasing the slide valve plate toward the fully closed position.

3. A device as in claim 1, the power operated means including sensor means sensitive to the rotative position of the throttle plate to position the slide valve to control the air flow through the opening.

4. A device as in claim 2, the throttle plate being fixedly mounted on a throttle shaft rotatably mounted in the throttle body, the shaft being slotted for receiving the slide plate therethrough, a recess in the shaft adjacent the slot, an actuating pin slidable in the recess and hooked to the slide plate, the power operated means including a solenoid having an armature movable into the recess into engagement with the pin for moving the same and the slide plate in one direction and retractable to permit movement of the pin and slide valve plate in the opposite direction under the bias of the spring means, and sensor means responsive to the angular position of the throttle plate to energize or deenergize the solenoid means to effect movement of the slide valve plate to control the air flow through the apertures in the throttle plate to control engine idle speed regardless of the angular position of the throttle plate.

5. A device as in claim 3, the power operated means, including motor means operably engaging the slide valve for moving the valve upon energization of the motor means, the position of the throttle plate locating the sensor means to operatively energize or deenergize the motor means to control the movement of the slide valve to control the air flow through the throttle plate in response to predetermined engine operating conditions calling for a predetermined schedule of air flow to the engine to maintain or establish a scheduled engine idle speed level.

* * * * *